United States Patent [19]

Pfister

[11] Patent Number: 4,700,612

[45] **Date of Patent: * Oct. 20, 1987**

[54] ELECTROPNEUMATIC DRIVE SYSTEM FOR CRUST BREAKING DEVICES AND PROCESS FOR OPERATING THE SAME

[75] Inventor: Hans Pfister, Duebendorf, Switzerland

[73] Assignee: Swiss Aluminium Ltd., Chippis, Switzerland

[ * ] Notice: The portion of the term of this patent subsequent to Aug. 19, 2003 has been disclaimed.

[21] Appl. No.: 839,980

[22] Filed: Mar. 17, 1986

Related U.S. Application Data

[63] Continuation-in-part of Ser. No. 602,698, Apr. 23, 1984, Pat. No. 4,606,257.

[51] Int. Cl.[4] ..... F15B 15/22

[52] U.S. Cl. ..... 91/471; 91/27; 91/415; 91/448

[58] Field of Search ..... 91/6, 20, 27, 32, 33, 91/415, 436, 448, 471; 60/407, 409; 204/67, 243, 244, 245, 246, 247

[56] References Cited

U.S. PATENT DOCUMENTS

| | | | |
|---|---|---|---|
| 3,000,361 | 9/1961 | Delany | 91/33 |
| 3,858,485 | 1/1975 | Rosaen | 91/415 |
| 3,943,972 | 3/1976 | Bitonti | 91/448 |
| 4,106,390 | 8/1978 | Kodaiva | 91/43 |
| 4,463,656 | 8/1984 | Mattsson | 91/32 |

*Primary Examiner*—Abraham Hershkovitz
*Attorney, Agent, or Firm*—Bachman & LaPointe

[57] ABSTRACT

The drive system for cells for fused salt electrolytic production of aluminum is supplied with compressed air via a compressed air network with compressor and compressed air reservoir. It comprises at least one working cylinder with piston and piston rod, a slide valve situated after the junction from the compressed air network, compressed air pipes and a microprocessor. During the thrust movement in the normal work cycle, the working cylinder forms a circuit together with a 5/2 channeling valve, a 3/2 channeling valve and the related compressed air pipelines; the said circuit is fed compressed air via a pressure reducing valve and the compressed air pipeline running from it. By briefly switching over the 5/2 channeling valve normal pressure can be employed and the positive chamber of the working cylinder evacuated, as a result of which the thrusting force supplied by the system can be greatly increased.

10 Claims, 2 Drawing Figures

ELECTROPNEUMATIC DRIVE SYSTEM FOR CRUST BREAKING DEVICES AND PROCESS FOR OPERATING THE SAME

CROSS-REFERENCE TO RELATED APPLICATIONS

This application is a Continuation-In-Part of U.S. patent application Ser. No. 602,698, Filed Apr. 23, 1984 now U.S. Pat. No. 4,606,257.

BACKGROUND OF THE INVENTION

The invention relates to an electropneumatic drive system which is fed compressed air from a network featuring compressor and compressed air storage facility; the said system is for crust breaking devices which are employed at aluminum fused salt reduction cells and is such that the said drive system comprises at least one working cylinder with piston and piston rod, a slide valve situated after the junction running from the network, valves, compressed air supply lines and a microprocessor. Further, the invention relates to a process for operating the electropneumatic drive system.

In the production of aluminum by fused salt electrolytic reduction of aluminum oxide, the latter is dissolved in a fluoride melt, comprised for the greater part of cryolite. The cathodically precipitated aluminum collects under the fluoride melt on the carbon floor of the cell, the surface of the molten aluminum itself forming the actual cathode. Dipping into the melt from above are anodes which in conventional processes are made of amorphous carbon. As a result of the electrolytic decomposition of the alumina, oxygen is formed at the carbon anodes and combines with the carbon of the anodes to form $CO_2$ and CO. The electrolytic process takes place in a temperture range of about 940°–970° C.

During the electrolytic process the aluminum oxide i.e. the alumina in the electrolyte, is consumed. At a lower concentration of about 1–2 wt. % alumina in the electrolyte the anode effect occurs whereupon the voltage rises from, for example, 4–5 V to 30 V and higher. In production, therefore, modern electrolytic cells are fed with alumina at intervals of only a few minutes, even if no anode effect occurs. To this end it is essential that an appropriate opening in the crust is always available in order that the alumina can be fed in measured quantities to the electrolyte. In the case of modern electrolytic cells therefore the alumina feeding system and crust breaking device are always combined both in terms of location and operation. Under normal operating conditions electronic process control is employed to trigger, e.g. every 2–5 min, the lowering and raising of the breaker chisel on the crust breaker; immediately before or after this the feeding of the alumina takes place. If the anode effect occurs, the frequency is greatly increased.

The lowering of the chisel causes any solidified electrolyte in the opening to be pushed down and redissolved in the melt.

The chisel of the crust breaking device is pneumatically driven almost throughout the whole of its stroke. By means of a mechanically or pneumatically operated stop switch the lowering of the chisel is brought to a halt and its return to the starting position triggered off. The signal for the return of the chisel can, however, also take place via measurement of an electric potential in that on immersion of the chisel in the electrolyte an electric circuit is completed.

In large pot rooms with a hundred or more reduction cells, each of which is fitted with at least one crust breaking device, the enormous quantities of compressed air employed represent a significant cost factor. Of necessity a great deal of energy is required also.

SUMMARY OF THE INVENTION

The object of the present invention is to develop a pneumatic system for driving crust breaking devices at aluminum fused salt reduction cells and for the operation of the said system a process which achieves the same performance while consuming much less compressed air and energy. The pneumatic drive system is to be fed from a compressed air network with compressed air reservoir and be comprised of at least one working cylinder with piston and piston rod, a slide valve situated after the branch in the network, valves, compressed air supply lines and a microprocessor for controlling the valves.

With respect to the device this object is achieved by way of

- a 5/2 channeling valve or directional valve which is situated after the slide valve and features an actuating facility which is controlled by a microprocessor via a connection therefrom,
- a pressure reducing valve which is installed via compressed air pipelines parallel to the 5/2 channeling valve,
- a 3/2 channeling valve or directional valve, which is situated after the 5/2 channeling valve and the pressure reducing valve and features an actuating facility which is controlled by a microprocessor via a connection therefrom,
- a working cylinder which is connected via evacuable compressed air lines on the side of the cylinder head, the negative side, to the 3/2 channeling valve and on the other, the positive side, which is penetrated by the piston rod, to the 5/2 channeling valve,
- a piston which is situated in the working cylinder, is movable along the central axis of the same, features a piston rod that has relatively large outer diameter and is connected to the chisel for breaking the electrolyte crust, and
- a device which is connected up via a plug-in connection to a microprocessor and indicates the completion of the thrust movement of the electropneumatic drive system, such that during its thrust stroke in the normal work cycle, the working cylinder together with the 5/2 channeling valve, the 3/2 channeling valve and the related compressed air supply lines forms a circuit supplied with compressed air via the pressure reducing valve (28) and its compressed air outlet line. The 5/2 channeling valve is symbolic of 5 way 2 position valves and the 3/2 channeling valve is symbolic of 3 way 2 position valves.

As a result of the said circuit the compressed air expelled from the working cylinder during the thrust stroke can be re-used. It is fed on the negative side into the working cylinder. The piston movement takes place as, on the positive side, the piston area exposed to the reduced pressure is smaller than on the negative side by the cross-sectional area of the piston rod.

BRIEF DESCRIPTION OF THE DRAWINGS

The invention is explained in greater detail in the following with the help of the schematic drawings viz.

DETAILED DESCRIPTION

Figure 1:
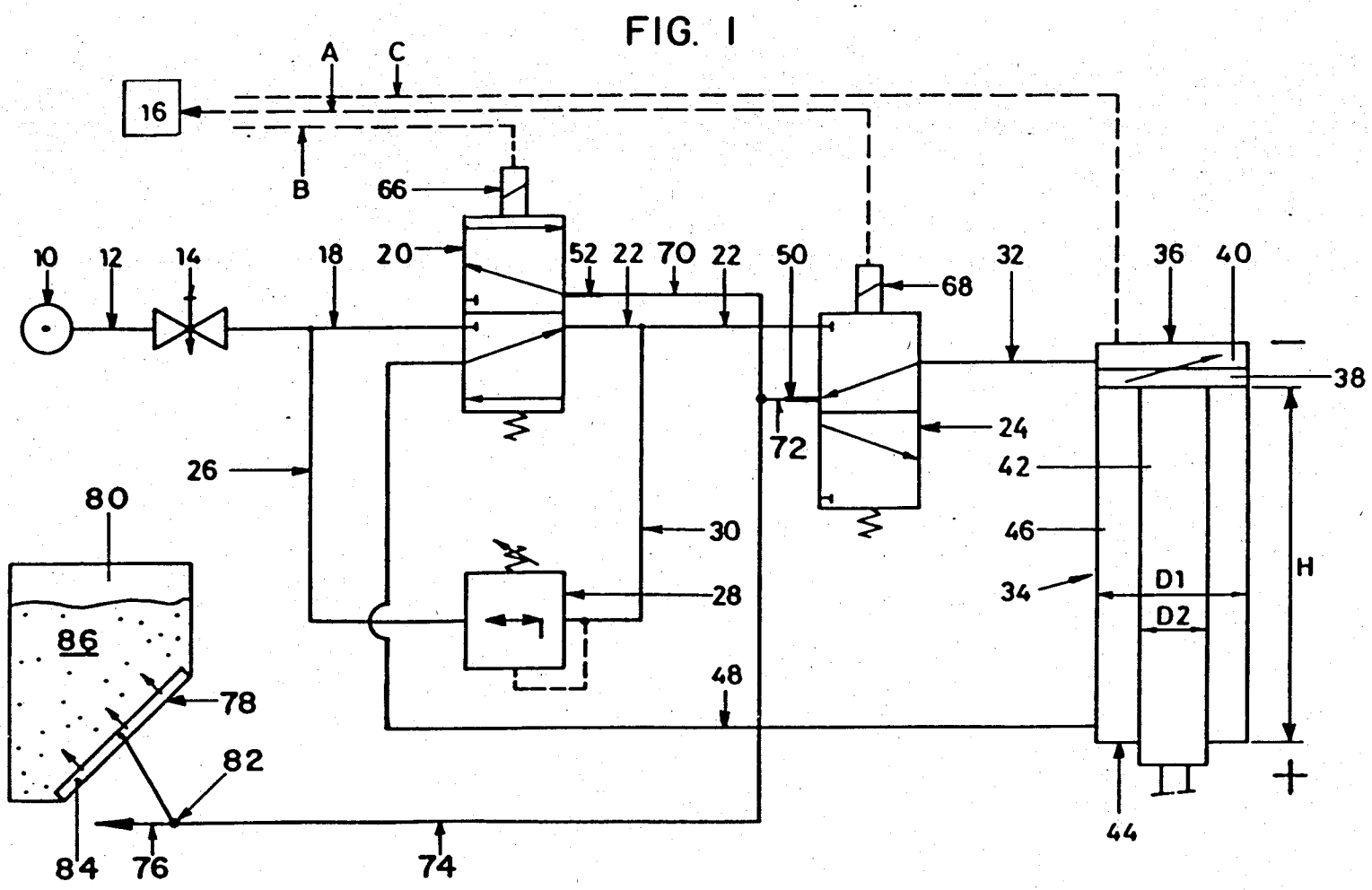
FIG. 1: A line drawing of the electropneumatic controls for working cylinders for crust breaker devices used on molten salt reduction cells for the production of aluminum.

In a unit employed to service aluminum fused salt reduction cells comprising combined alumina feeder and crust breaking device the air expelled on the return stroke of the piston can be usefully employed if it is injected in the region of the portioned feeding device into the conical part of the day's supply silo. This improves the flow characteristics of the alumina at the lowest part of the silo where the pressure is greatest, and does so without having to expend special energy for this purpose.

In selecting the dimensions of the piston rod cross section or its out diameter, two factors have to be taken into account:

The smaller the piston rod the smaller is the difference in force between the negative and positive side acting on the piston i.e. the smaller is the power supplied by the piston.

The, in general, vertical or almost vertical working cylinder of crust breakers for fused salt reduction cells must also be capable, even with reduced pressure, of raising a breaker chisel which becomes stuck in the crust opening. Consequently the outer diameter of the piston rod must not be too great, even though this would be desirable with respect to efficiency.

It has been shown advantageous to design the piston rod with an outer diameter which amounts to 25–85%, preferably 40–70%, of the inner diameter of the working cylinder.

As piston rods of the kind described above must in general have a relatively large outer diameter, they are usefully tubular in shape.

When returned to its non-operative resting position, the crust breaker must have withdrawn the chisel out of the region of the carbon anodes in order that no damage occurs during anode changes or other cell operations. With this in mind it has been found that it is advantageous for the working cylinder to have a stroke of length 400–600 mm.

For economic reasons (consumption of compressed air, wear) the compressed air circuit is operated, under normal operating conditions, at reduced pressure; that circuit is therefore supplied with compressed air via a pressure reducing valve which reduces the pressure coming from the overall compressed air network by 35–75%, preferably by 45–55%. The pressure in the network generally lies in the range 6–8 bar.

In practice these pressure reduction valves, and the other valves, are mounted on a common base plate, usefully on the cylinder head of the working cylinder. This lies out with the hot region of the cell and is easily accessible from outside.

Referring to the drawings, a pipe 12, branching out from a conventional industrial network 10 for the supply of compressed air, leads to a slide valve 14 which, usefully, can be operated manually. The network 10 for compressed air supply is fed by a compressor and is stabilized by means of a compressed air reservoir.

A compressed air pipe 18 leads away from slide valve 14 to the 5/2 channeling valve 20. The compressed air pipe 22 running from the 5/2 channeling valve leads to the 3/2 channeling valve 24.

Branching out from pipe 18 is a compressed air pipe 26 which leads to the reduction valve 28. The air at reduced pressure is fed via pipe 30 into pipe 22. Compressed air pipe lines 26 and 30 and the pressure reduction valve 28 form therefore a by-pass round the 5/2 channeling valve.

A compressed air pipe 32 runs from the 3/2 channeling valve 24 to the negative side of the working cylinder, in other words to the space 40 formed between the cylinder head 36 and the piston 38. The working cylinder 34 has an inner diameter $D_1$, the piston rod 42 which can move with a stroke H coaxially within the cylinder 34 has an outer diameter $D_2$.

The space 46 delimited by the inner face of the working cylinder 34, the piston rod 42, the piston 38 and the base 44 of the cylinder is defined as the positive side of the working cylinder. This space 46 is connected to the 5/2 channeling valve 20 via a compressed air pipe 48.

When the pneumatic drive system is in the non-operating position, space 40 is evacuated via pipe 32, 3/2 channeling valve 24 and outlet pipe 50, while space 46 is kept at reduced pressure.

At the start of the working phase the microprocessor 16 reverses the 3/2 channeling valve 24 via connection A and actuating facility 68; the space 40 on the negative side of the working cylinder is subjected to reduced pressure. If the thrusting force of the working cylinder 34 has to be increased briefly, then the microprocessor 16 reverses the 5/2 channeling valve 20 via connection B and actuating facility 66; the pressure reducing valve 28 is closed and the space 46 is evacuated via compressed air line 48, 5/2 valve and outlet pipe 52.

Outlet pipe 52 leads to lines 70, 74 and 76. Valve 82 may direct evacuated air from lines 52, 70 and 74 to the atmosphere via line 76 or to the conical part 78 of silo 80 containing alumina 86 for feeding to the electrolytic cells via feeding means 84. Outlet line 50 can also be connected to line 70 via line 72. This permits the air expelled on the return stroke of the piston to be usefully employed by injecting same in the conical region of the proportioned feeding device and improves the flow characteristics of the alumina at the lowest part of the silo where pressure is greatest while doing so without expending extra energy.

Figure 2:
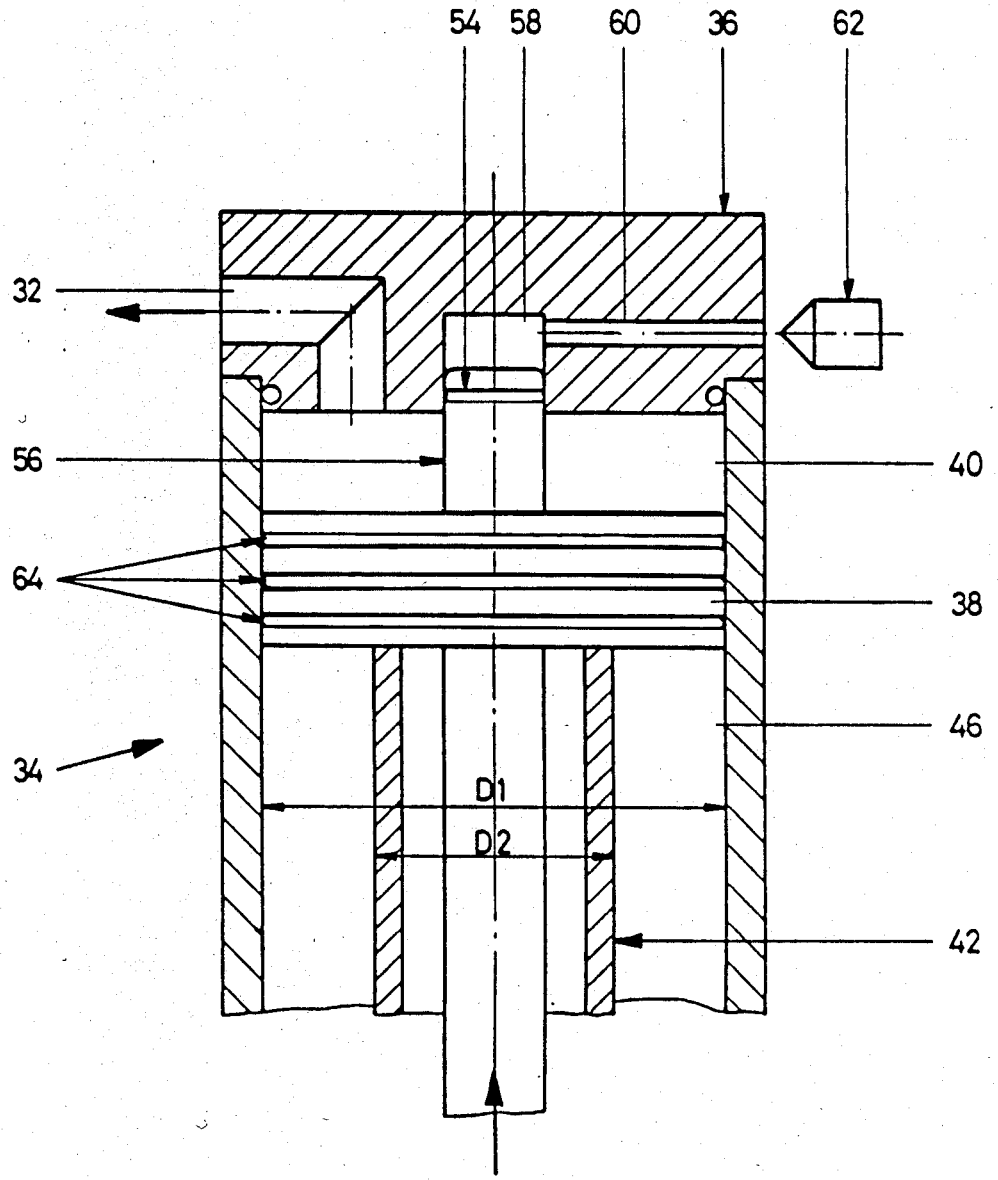
FIG. 2: A cross section through the negative part of the working cylinder.

FIG. 2 shows the upper region of the working cylinder 34 in which the piston 38 can be moved in the axial direction. The cylinder head 36 is mounted, air-tight, on a pipe of inner diameter $D_1$. An evacuation channel 32 is provided in the cylinder head 36. The cylindrical shaped piece 56 projecting beyond the piston 38 and featuring sealing ring 54 fits into a corresponding recess 58 in the cylinder head 36. Leading out from this recess 58 to the outside is an evacuating channel 60 and such that this outlet can be blocked off with a regulating valve 62.

The piston 38 features three sealing rings 64. In order to save material and weight the piston rod 42 of outer diameter $D_2$ is tubular in form.

In the non-operative position the piston of the working cylinder is preferably acted on by the reduced network pressure on its positive side while the negative side of the working cylinder is evacuated. The piston is pressed e.g. on a stop plate on the cylinder head. If the piston is to be fixed in the non-operative position for an extended period, in particular when removing the crust breaking device, the piston can be held in place by means of a locking mechanism.

When the cell is in operation, it must be possible to determine whether the chisel has fully penetrated the crust or not. For this purpose a mechanically or pneumatically operable end switch is provided e.g. in the interior of the working cylinder. Using an electrical circuit the moment of immersion of the chisel in the electrically conductive molten electrolyte can also be employed to signal the end position.

With respect to the process for operating the device the object is achieved by way of the invention in that the microprocessor, in a first selectable time interval, alternately feeds a control signal to the 3/2 channeling valve which is in the resting position and which has been evacuated, via a compressed air line, in the space inside the working cylinder between the cylinder head and the piston, as a result of which the closed circuit is formed and, if necessary, unlocks the piston, and, after the end piston has been reached, cancels the control signal for the 3/2 valve and, if necessary, locks the piston in place.

Should the breaker chisel not reach the end position during a second selectable time interval, the microprocessor switches over the 5/2 channeling valve by means of a control signal. The reduction valve is thus cut out and the interior of the working cylinder which is penetrated by the piston rod, the positive end, is evacuated via a compressed air line and the 5/2 channeling valve.

The chisel failing to reach the end position means that the crust is not penetrated completely, and the alumina fed to that spot does not reach the electrolyte. By switching over the 5/2 channeling valve the force from the pneumatic drive system acting on the chisel is increased greatly:

The pressure acting on the piston on the negative side is increased and with that also the force.

By evacuating the positive side of the working cylinder the counter-pressure is eliminated, as a result of which the force acting on the piston is increased further.

If, in spite of cutting out the pressure reduction valve, the chisel does not reach the end position, then the microprocessor causes the striking action to be repeated at brief intervals until the crust is penetrated.

To achieve the maximum saving in energy, the microprocessor control can be arranged such that by switching over the 5/2 channeling valve the full force is applied only when the chisel is in the lowest part of its stroke e.g. in the last 100 mm of the downward movement. By repeating the movement with full force at short intervals the chisel is then moved only in the lowest part of its stroke so that correspondingly less compressed air is consumed.

With all variations of switching arrangements the return movement to the negative side of the cylinder always takes place under reduced pressure.

The compressed air drawn from the distribution network for the electropneumatic drive system is usually 6–8 bar, the reduced pressure 3–4 bar. In practice, in smelter operations, the first selectable time interval for normal operation of the device is usefully in the range of 0.5 to 5 minutes. The second selectable time interval, for initiating the higher pressure, is 0–3 times the first time interval. If the chisel does not reach the end position (completely penetrated crust), then the system switches over to application of full force preferably immediately or after a few seconds. According to another mode of operation the lowering of the chisel can be repeated first with reduced pressure at shorter time intervals than the first selected time interval, before switching over to the application of full force.

Also within the scope of the invention is to employ a closed circuit comprising working cylinder, 5/2 channeling valve, 3/2 channeling valve and the related compressed air lines, such that the said circuit is not fed with compressed air from the pressure reducing valve but directly from the pipe branching out from the compressed air network. The maximum possible force can be achieved, however, if not only the pressure reducing valve is cut out but also if the positive side of the working cylinder is evacuated. Of course in these cases the consumption of compressed air is correspondingly greater.

The following numerical examples show the different amounts of compressed air consumed by a conventional working cylinder and by a working cylinder according to the invention as employed for the pneumatic drive of crust breakers in electrolytic cells. When considering these examples, it must be taken into account that the saving is repeated at short intervals and that several hundred such working cylinders are in operation in an aluminum smelter pot room.

EXAMPLE NO. 1

The diameter $D_1$ of the working cylinder is 200 mm, the piston rod diameter $D_2$ is 50 mm, the stroke H is 500 mm and the pressure P in the compressed air network is 7 bar. This working cylinder is operated according to the conventional procedure i.e. without a closed circuit. All of the air emerging from the working cylinder is simply expelled to the surroundings

| | |
|---|---|
| Air consumption for a downwards movement | |
| Filling the negative side: | |
| $D_1^2 \cdot \frac{\pi}{4} \cdot H \cdot p$ | $= 109.9\ dm^3$ |
| Evacuating the positive side: | |
| $(D_1^2 - D_2^2) \cdot \frac{\pi}{4} \cdot H \cdot p$ | $= 103.0\ dm^3$ |
| Total | $212.9\ dm^3$ |
| Air consumption for an upwards movement | |
| Filling the positive side: | |
| $(D_1^2 - D_2^2) \cdot \frac{\pi}{4} \cdot H \cdot p$ | $= 103.0\ dm^3$ |
| Evacuating the negative side: | |
| $D_1^2 \cdot \frac{\pi}{4} \cdot H \cdot p$ | $= 109.9\ dm^3$ |
| Total | $212.9\ dm^3$ |

In all therefore for a downwards and upwards movement the amount for air consumed is 425.8 $dm^3$.

EXAMPLE NO. 2

A working cylinder with an internal diameter $D_1$ of 200 mm features a piston with tubular shaped piston rod of outer diameter $D_2$ equal to 100 mm. The length of stroke H is 500 mm, the reduced working pressure $P_{red}$ is 3.5 bar. This working cylinder is built into an electro-pneumatic drive system according to the invention. The thrust movement of the cylinder takes place in the normal case by means of a closed circuit.

| | |
|---|---|
| Air consumption for a downwards movement | |
| Filling the negative side making use of the air expelled from the space on the positive side: | |
| $P_{red} \cdot \frac{\pi}{4} \cdot H \cdot D_2^2$ | $= 13.7\ dm^3$ |
| Air consumption for a downwards movement | |
| Filling the positive side | |
| $P_{red} \cdot \frac{\pi}{4} \cdot H \cdot (D_1^2 - D_2^2)$ | $= 41.2\ dm^3$ |
| Evacuating the negative side | |
| $P_{red} \cdot \frac{\pi}{4} \cdot H \cdot D_1^2$ | $= 55.0\ dm^3$ |
| Total for a downwards and an upwards movement | $109.9\ dm^3$ |

The consumption of compressed air or energy is therefore lowered by 26% compared with the conventional practice used up to now. This saving is realized during normal servicing of the cell; when the force is increased briefly the saving decreases.

The above calculation of compressed air consumption refers to cylinder dimensions and pressure ranges in the compressed air network such as are to a large extent normal in today's operating conditions.

In an aluminum smelter with 200 reduction pots, each fitted with 6 crust breakers, the daily savings in compressed air with servicing at 3 minute intervals and a reduced pressure of 3.5 bar is:

$$(425.8 - 109.9) \cdot 6 \cdot 2 \cdot 480 \cdot 10^{-3} = 18{,}200\ m^3$$

What is claimed is:

1. A process for operating an electropneumatic drive system which is fed compressed air from a compressed air network for operating an electropneumatic drive system for crust breaker devices for fused salt aluminum reduction cells which comprises:

providing a compressed air network in fluid communication with a slide valve which in turn is in fluid communication with an operatively connected to a 5/2 channeling valve downstream from said slide valve, a pressure reducing valve in fluid communication with said slide valve downstream from said network and parallel to said 5/2 valve, and a 3/2 channeling valve downstream from both said 5/2 valve and pressure reducing valve and in fluid communication therewith;

providing a working cylinder operatively connected to said network and downstream from said 3/2 valve including a cylinder head, piston and piston rod and a positive side penetrated by the piston rod and a negative or working side;

connecting the working cylinder in fluid communication on the negative side to the 3/2 channeling valve and on the positive side to the 5/2 channeling valve;

feeding a control signal via a microprocessor to the 3/2 valve in the resting postiion to evacute said negative side whereby a closed circuit is formed between the 3/2 valve and the working cylinder and thrust is provided to the piston; and cancelling said control signal after the end position of the piston stroke has been reached.

2. Process according to claim 1 including the step of feeding a second control signal via said microprocessor to the 5/2 valve when said end position has not been reached whereby the pressure reducing valve is cut out and the positive side is evacuated and thrust to the piston is increased.

3. Process according to claim 1 wherein the pressure to said compressed air network is 6–8 bar.

4. Process according to claim 3 wherein the reduced pressure is 3–4 bar.

5. Process according to claim 2 including providing a time interval before inititating said second control signal.

6. Process according to claim 2 including the step of repeating said second signal when said end position is still not reached thereby causing the striking action to be repeated.

7. Process according to claim 6 wherein the piston stroke is 400 to 600 mm and wherein said repeated striking action takes place only in the last 100 mm of said stroke.

8. Process according to claim 1 wherein the thrust stroke is performed with a closed circuit made up of the working cylinder, 5/2 valve, 3/2 valve and means connecting the working cylinder.

9. Process according to claim 5 wherein a first selectable time interval of 0.5 to 5 minutes is provided to reach said end position and wherein said time interval is 0 to 3 times that of the first selectable time interval.

10. Process according to claim 1 including the step of feeding air from said channeling valves to the conical part of an alumina silo on the reduction pot used for fused salt electrolytic production of aluminum.

* * * * *